US006086690A

United States Patent [19]

Wycliffe et al.

[11] Patent Number: 6,086,690

[45] Date of Patent: Jul. 11, 2000

[54] PROCESS OF PRODUCING ALUMINUM SHEET ARTICLES

[75] Inventors: Paul Wycliffe; Edward Stanley Luce, both of Kingston, Canada

[73] Assignee: Alcan International Limited, Montreal, Canada

[21] Appl. No.: 09/036,649

[22] Filed: Mar. 6, 1998

Related U.S. Application Data

[60] Provisional application No. 60/040,489, Mar. 7, 1997.

[51] Int. Cl.[7] ..... C22F 1/04

[52] U.S. Cl. ..... 148/552; 148/696

[58] Field of Search ..... 148/552, 696, 148/551

[56] References Cited

U.S. PATENT DOCUMENTS

| | | | |
|---|---|---|---|
| 5,423,925 | 6/1995 | Shoji et al. | 148/552 |
| 5,514,228 | 5/1996 | Wyatt-Mair et al. | 148/551 |
| 5,655,593 | 8/1997 | Wyatt-Mair et al. | 148/552 |
| 5,772,802 | 6/1998 | Sun et al. | 148/552 |

FOREIGN PATENT DOCUMENTS

| | | |
|---|---|---|
| 7-41896 | 2/1995 | Japan . |
| WO 97/11205 | 3/1997 | WIPO . |

OTHER PUBLICATIONS

ASM Handbook: Forming and Forging. vol. 14. 9th ed. 1988. p. 13.

Metals Handbook: Properties and Selection: Nonferrous Alloys and Pure Metals. vol. 2. 1979. pp. 28 and 29.

*Primary Examiner*—Prince Willis
*Assistant Examiner*—Tima McGuthry-Banks
*Attorney, Agent, or Firm*—Cooper & Dunham LLP

[57] ABSTRACT

A process of producing an aluminum alloy sheet article of high yield strength and ductility suitable, in particular, for use in manufacturing automotive panels. The process comprises casting a non heat-treatable aluminum alloy to form a cast slab, and subjecting said cast slab to a series of rolling steps to produce a sheet article of final gauge, preferably followed by annealing to cause recrystallization. The rolling steps involve hot and warm rolling the slab to form an intermediate sheet article of intermediate gauge, cooling the intermediate sheet article, and then warm and cold rolling the cooled intermediate sheet to final gauge at a temperature in the range of ambient temperature to 340° C. to form said sheet article. The series of rolling steps is carried out continuously without intermediate coiling or full annealing of the intermediate sheet article. The invention also relates to the alloy sheet article produced by the process.

13 Claims, 2 Drawing Sheets

PROCESS OF PRODUCING ALUMINUM SHEET ARTICLES

CROSS-REFERENCE TO RELATED APPLICATIONS

This application claims the benefit of U.S. Provisional Application Ser. No. 60/040,489, filed Mar. 7, 1997.

BACKGROUND OF THE INVENTION

I. Field of the Invention

This invention relates to a process of producing an aluminum sheet article. More particularly, the invention relates to such a process for producing sheet articles made of non heat-treatable alloys suitable for shaping by press forming, particularly 5000 series aluminum alloys suitable for use, for example, in manufacturing automotive panels.

II. Description of the Prior Art

Aluminum alloys of the 5000 series (i.e. those having magnesium alone as the principal alloying element) are commonly used for the fabrication of automotive panels (fenders, door panels, hoods, etc.) and, for such applications, it is desirable to provide alloy sheet product having high yield strength and high ductility. Aluminum alloy sheet articles of suitable gauge and yield strength can be produced by continuous casting followed by rolling to gauge. In a traditional continuous casting process, the metal emerging from the caster is hot and warm rolled to an intermediate gauge and is then coiled (at a temperature of about 300° C.) and transported to another mill (which may be at another plant) and cold rolled to final gauge at a temperature that does not exceed 160° C.

For clarification, it should be mentioned at this point that the term "hot rolling" conventionally means rolling carried out at a temperature above the recrystallization temperature of the alloy, so that the alloy recrystallizes by self-anneal either between roll passes or in the coil after rolling. The term "cold rolling" conventionally means work rolling with substantial work hardening rates such that the alloy exhibits neither recrystallization nor substantial recovery during or after rolling. The term "warm rolling" means rolling carried out between the two, i.e. such that there is no recrystallization but such that the yield strength is reduced substantially due to a recovery process. For aluminum alloys, hot rolling is carried out above 350° C., and cold rolling is carried out below 150° C. Obviously, warm rolling is carried out between 150 and 350° C.

Unfortunately, the conventional process mentioned above is cumbersome and expensive in that intermediate coiling, storage and transportation are required to obtain a sheet article having a suitable microcrystalline structure to produce the desired yield strength.

In U.S. Pat. No. 5,514,228, which issued on May 7, 1996 to Kaiser Aluminum & Chemical Corporation, inventors Wyatt-Mair et al. disclose an in-line continuous casting process in which the sheet is rolled to final gauge without an intermediate coiling step. However, a solution heat treatment step is required ahead of the final rolling pass, such that the sheet is continuously fully annealed prior to final coiling. Unfortunately, 5000 series alloys cannot be strengthened by solution heat treatment in the way contemplated by Wyatt-Mair et al.

In Japanese patent disclosure JP 7-41896, published on Feb. 10, 1995 in the name of Sky Aluminum Co., Ltd., inventors Kamishiro et al. discloses a direct chill (DC) casting process for what may or may not be 5000 series alloys (this is not stated explicitly), in which a warm rolling step is provided between hot rolling and cold rolling steps. The warm rolling step results in partial annealing of the sheet at temperatures in the range of 100 to 350° C. However, the sequence of steps is discontinuous in that the sheet is coiled at least between the hot and cold rolling stages. Also, the aim of the warm rolling step appears to be to improve formability, as opposed to improving yield strength.

There is therefore a need for a process of producing sheet articles of 5000 series aluminum alloys, and other non heattreatable aluminum alloys, on a continuous basis while obtaining alloy sheet products of high yield strength.

SUMMARY OF THE INVENTION

An object of the invention is to produce non heat-treatable aluminum alloy sheet articles suitable, in particular, for the manufacture of automotive panels, in a convenient and economical manner.

Another object of the present invention, at least in a preferred form, is to provide a process of producing sheet articles of 5000 series aluminum alloys on a continuous basis without resorting to two-stage rolling techniques requiring an intermediate coiling operation, and yet be able to produce alloy products of high yield strength.

According to one aspect of the invention, there is provided a process of producing an aluminum alloy sheet article, which comprises: casting a non heat-treatable aluminum alloy to form a cast slab, and subjecting the cast slab to a series of rolling steps to produce a sheet article of final gauge, the rolling steps comprising: hot and warm rolling the slab to form an intermediate sheet article of intermediate gauge, cooling the intermediate sheet article, and then warm and cold rolling the cooled intermediate sheet to final gauge at a temperature in the range of ambient temperature to 340° C. to form the sheet article; the series of rolling steps being carried out continuously without intermediate coiling or full annealing of the intermediate sheet article.

The process defined above produces an alloy in the so-called H2 temper. Further annealing to cause recrystallization produces a sheet article suitable for automotive use. The sheet article in the H2 temper may itself be a useful commercial article (i.e. it may be sold to other parties for finishing).

According to another aspect of the invention, there is provided an aluminum alloy sheet article made of a non heat-treatable aluminum alloy having, when produced by a process comprising: casting a non heat-treatable aluminum alloy to form a cast slab, and subjecting said cast slab to a series of rolling steps to produce a sheet article of final gauge; the rolling steps comprising: hot and warm rolling the slab to form an intermediate sheet article of intermediate gauge, cooling the intermediate sheet article, and then warm and cold rolling the cooled intermediate sheet to final gauge at a temperature in the range of ambient temperature to 340° C. to form said sheet article; said series of rolling steps being carried out continuously without intermediate coiling or full annealing of the intermediate sheet article.

As mentioned above, the invention requires hot and warm rolling and then warm and cold rolling carried out without intermediate coiling or full annealing. When rolling continuous cast slab or direct chill (DC) cast ingot, the hot slab loses heat to the air and to the rolls, so that hot rolling tends to finish in the warm rolling regime (i.e. below the crystallization temperature).

This is what is meant by hot and warm rolling. During hot rolling, the metal fully recrystallizes to release any strain energy that has built up during the casting process. The temperature at which this occurs depends to some extent on the amount of cold working that is taking place at the same time, as well as on alloy composition. During warm rolling, strain energy built up as a result of the rolling process is gradually released and the metal is said to "recover." As with recrystallization, the degree of recovery depends on the amount of cold working and the composition of the alloy, in addition to temperature. There is an important further distinction between recrystallization and recovery, namely that recrystallization results in a measurably sharp decrease in strain and takes place entirely during hot rolling, whereas recovery is a gradual, smooth decrease in strain over the entire length of both the warm and cold rolling cycles, but most of the strain is released during "warm" rolling.

Similarly, the reference to warm and cold rolling means that the rolling commences as warm rolling, but cooling makes the final pass occur without much recovery.

It should be noted that the process of the invention may, if desired, be carried out on cast slab produced continuously, e.g. by means of a twin belt caster, or on slab produced by separate steps, e.g. by means of direct chill (DC) casting followed by hot rolling in a reversing mill (breakdown mill), to produce a DC transfer slab. Block casting and other continuous casting methods that produce materials thick enough to require a hot and warm rolling step may also be used for producing this slab. Ideally, however, the alloy is continuously cast into a slab by means of a twin belt caster and is reduced in thickness to the desired gauge by a series of rolling steps carried out immediately on the slab before it cools. The sheet article production process is then continuous from start to finish.

The cooling of the intermediate sheet prior to the final warm and cold rolling at a temperature within the indicated range increases the yield strength of the final sheet article. This cooling normally has to be forced (i.e. accelerated) since there is insufficient time between the rolling passes for natural cooling, unless the process is carried out in a reversing mill. The forced cooling step affects the temperature of the final rolling step and this in turn reduces the grain size. Higher levels of stored energy occur with lower rolling temperatures, and lead to a finer grain size upon recrystallization. Good mechanical properties result when the last rolling pass is carried out at the stated low temperature and recrystallization occurs in a subsequent batch anneal. A suitable batch anneal can be carried out, for example, by coiling the final gauge sheet article and heating it to a temperature in the range of 325° C. to 450° C. for a time such that the entire coil reaches this temperature, and then allowing the annealed product to cool naturally to ambient temperature.

The process of the invention is of benefit for any non heattreatable aluminum alloy that is to be in the fully annealed condition in the final product form. However, grain size strengthening is probably most important in the 5000 series alloys commonly used for automotive applications. The process is useful for all 5000 series alloys that are shipped in the fully annealed condition, but the process is particularly useful for alloy AA5754 since this alloy contains limited amounts of Mg in order to avoid stress corrosion cracking, so that grain size strengthening is particularly important for this alloy. Alloys with higher Mg contents, such as AA5182, are susceptible to stress corrosion cracking, but tend to have higher strength due to their higher Mg content. The invention is still, of course, of benefit for such alloys, but the benefit may be less apparent.

The rolling steps are preferably carried out in a tandem mill (or equivalent) rolling plant having a plurality of rolling stands. A tandem mill plant carries out the rolling steps to final gauge continuously with little delay between rolling passes, i.e. with minimum distance between rolling stands. The time between rolling steps is, of course, fixed by the line speed and the distance between the rolling stands. When the metal sheet reaches the final rolling stand, it is normally too hot for the required warm and cold rolling step and it first has to be subjected to accelerated cooling so that the final rolling reduction occurs at a temperature in the required range from ambient temperature (about 25° C.) to 340° C., more preferably ambient temperature to 280° C. As already noted, the final rolling step is carried out without intermediate coiling or full annealing of the intermediate sheet article.

The intermediate sheet is preferably cooled to a temperature in the given range prior to the warm and cold rolling to final gauge by spraying water, blowing forced air, or applying other means of accelerated cooling onto one or both sides of the intermediate sheet article ahead of the warm and cold rolling step.

The intermediate sheet article is also preferably made to undergo a large reduction in thickness, e.g. a reductions in thickness by at least 20%, and more preferably at least 60%, during the warm and cold rolling to final gauge, to ensure moderately fine (e.g. 15 $\mu$m to 30 $\mu$m) grain size and high (e.g. 105 MPa to 120 MPa) yield strength (in the case of alloy AA5754).

For the purposes of the present invention, the higher the yield strength and the higher the ductility, the better. For alloy AA5754, a yield strength in the range of 105 to 115 MPa, ideally at least 110 MPa, and a 24% total elongation are typical target values of strength and ductility. Such values can be obtained by the process of the present invention.

A surprising aspect of the present invention is that the yield strength of the finished sheet ends up being higher than expected, i.e. it approaches that of sheet produced in the conventional way and is suitable for automotive applications. One would not normally expect such a result because of the rapid in-line cooling that is normally required just ahead of the final rolling pass.

The process of the present invention may also result in a sheet article exhibiting plastic anisotropy (R-value and crystallographic texture) which is superior to the sheet article produced by the conventional two-step process or superior to the sheet article produced by hot/warm rolling without cooling to ensure low final pass temperatures.

The process of the invention, at least in its preferred forms, provides a way of making auto body structural 5000 series aluminum sheet (or other non heat-treatable aluminum alloy) having good mechanical properties that is continuously rolled to final gauge at the exit from a continuous caster (twin-belt or block caster). The invention thus eliminates the need to subject re-roll coil to a separate and expensive cold rolling step and represents a more cost-effective way of producing 5000 series alloy sheet articles.

An advantage of the invention is that, while self-annealing does not produce the preferred microstructure and properties, recrystallization after rolling at lower temperatures, followed by annealing, does produce the desired fine grain size, high strength and favorable crystallographic texture.

DETAILED DISCLOSURE OF THE INVENTION

As noted above, the present invention relates to a rolling process by which a continuously cast slab is directly hot/warm/cold rolled to final gauge without intermediate coiling or full annealing. The grain size, yield strength and ductility of the sheet so produced are comparable to sheet of the same alloy which has gone through the standard, [much] less economical, two-step hot roll and cold roll process.

The method of casting the alloy slab and the way in which the individual rolling steps are carried out are largely conventional and may be, for example, as described in U.S. patent application Ser. No. 08/676,794, filed on Jul. 8, 1996 and assigned to Alcan International Limited (and corresponding PCT Patent Application Publication No. WO 98/01592, published on Jan. 15, 1998). The disclosure of these applications is incorporated herein by reference. In view of this, a detailed description of the casting and rolling steps and equipment is believed to be unnecessary.

Figure 1:
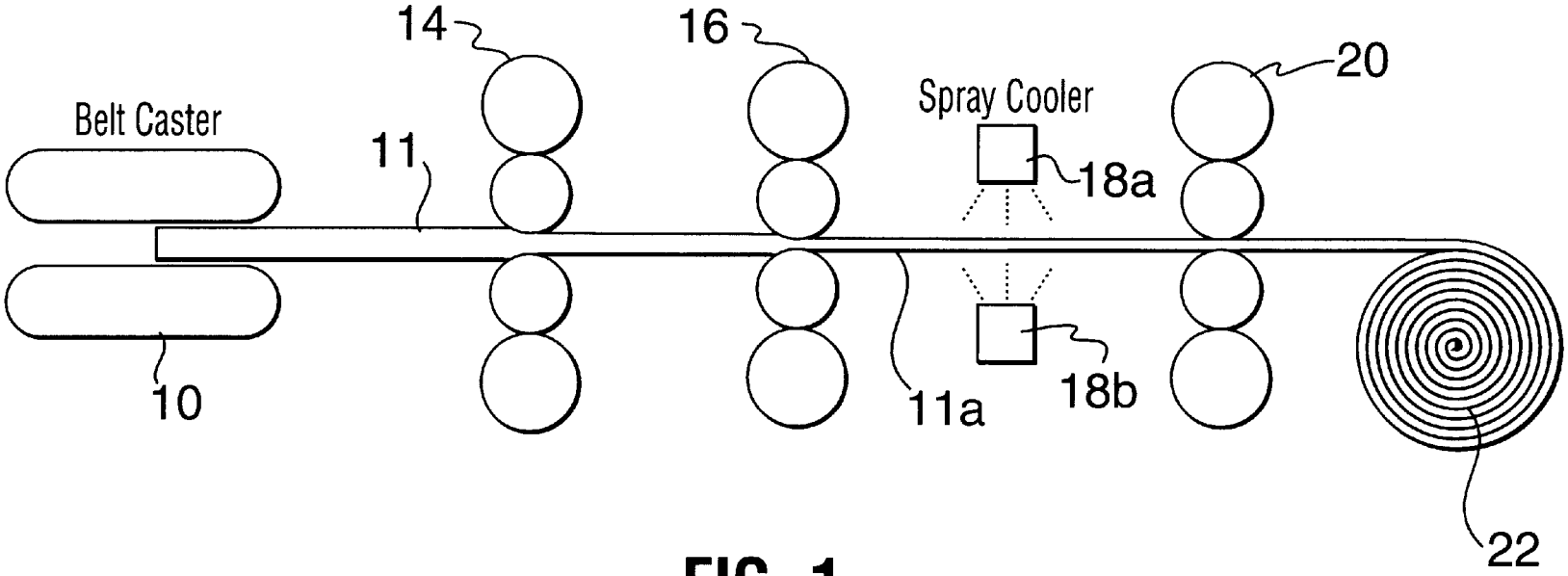
FIG. 1 of the accompanying drawings is a schematic representation of a preferred form of the process of the present invention carried out in a conventional tandem mill.

A preferred form of the process, and a stylized illustration of the equipment employed, is illustrated in FIG. 1. The drawing shows the use of a twin-belt caster 10 for the continuous production of a cast slab 11. The slab emerges from the caster at a temperature in the range of 400 to 520° C. and, in the illustrated embodiment, is subjected to two hot/warm rolling steps upon passing through first and second rolling mills 14 and 16. The number of such mills and rolling passes depends on the initial thickness of the cast slab and the reduction required. Clearly, more or fewer rolling mills may be provided, as required.

The hot and warm rolling passes result in an intermediate sheet article 11*a* of intermediate thickness. This article generally has a temperature in the range of 300 to 400° C., which is usually too high to achieve a fine grain size on recrystallization at final gauge. Accordingly, the intermediate sheet article is sprayed with cold water on both sides from spray nozzles 18*a* and 18*b* to bring the temperature of the intermediate article to within the required range of ambient temperature (e.g. 25° C.) to 340° C. (preferably ambient to 280° C.). The cooled intermediate article 11*a* is then passed through a further rolling mill 20 and reduced in thickness preferably by at least 40%, more preferably by at least 60%, to final gauge (usually in the range of 1 to 3 mm). The significant reduction in thickness produces a suitable grain size and yield strength. Although only a single rolling stand 20 is shown, more than one could be provided, if necessary, depending on the degree of thickness reduction required.

The sheet product is then coiled at 22 and subjected to a batch anneal for a time such that the entire coil reaches a temperature of 325 to 450° C. As with most batch anneals, this entails a prescribed isothermal heat "soak" to ensure that the whole coil reaches the same peak temperature. This anneal step results in recrystallization of the uncrystallized (or only partially annealed) coiled product.

It is possible also to recrystallize the coils via a continuous annealing process off-line. This will give a fine grain size and a high yield strength.

The final cold pass at 20 allows better shape control of the sheet article and a finer grain size and better strength after carrying out the recrystallization batch anneal. This final rolling pass is similar to the cold rolling stage that the metal normally experiences in the conventional two-step process, but surprisingly can be carried out on the same line as the casting and intermediate rolling. The working temperature range of the final pass is ambient (25° C.) to about 340° C., with the preferred range being ambient to about 280° C.

It will be noticed that all of the rolling steps are carried out without any intermediate coiling or intermediate annealing steps. The process is therefore continuous and unbroken from formation of the cast slab to reduction to final gauge for the case of continuous cast slab, and provides finished product via tandem mill rolling of DC transfer slab.

The present invention is illustrated in more detail in the following Examples, which should not be considered limiting.

EXAMPLE 1

Hot and Warm Rolling of Continuously Cast 5754 Alloy

Samples of 5754 alloy cast on a twin belt caster were hot rolled with a variety of final pass temperatures. The effect of reduced final pass temperature on grain size, tensile properties and formability were evaluated.

Material

Samples were cut from 19 mm slab, cast on a twin belt caster. The composition of the material (AA5754) is shown in Table 1.

TABLE 1

Composition of 5754 Material

| Material | Composition (wt % by ICP*) | | | | | | | | | | |
|---|---|---|---|---|---|---|---|---|---|---|---|
| | Si | Fe | Cu | Mn | Mg | Ti | Ni | Zn | Cr | V | Zr |
| AA5754 | .053 | .18 | .004 | 0.24 | 3.13 | .017 | .002 | .008 | <.005 | .007 | <.001 |

*ICP stands for "inductively coupled plasma", the method used for the chemical analysis.

Processing

Specimens 4.5 inches wide were fitted with a thermocouple in one end. Each specimen was reheated to 450° C. and hot rolled immediately. A 4-pass schedule was used to reduce the slab to 2 mm final gauge and the temperatures indicated by the thermocouple in the trailing end of the strip were recorded. After the third pass, the slab was allowed to cool (if required) to reach the target temperature for the final pass. Table 2 gives the pass schedule, and the mill entrance and exit temperatures for each pass given to the three samples. Specimen IDs are based on the temperature at the start of the final pass, $T_{in}$. Thus, final pass temperatures are 340° C., 300° C., and 220° C. (rounded off to the nearest 10°).

After machining tensile specimens, all sample material was annealed for 2 hours at 350° C., with 50° C./hour temperature recovery and cooling.

TABLE 2

Mill Schedule, Entrance and Exit Temperature (° C.)

| Sample | Pass 1 (13 mm) | | Pass 2 (8 mm) | | Pass 3 (4 mm) | | Pass 4 (2 mm) | |
|---|---|---|---|---|---|---|---|---|
| | $T_{IN}$ | $T_{OUT}$ | $T_{IN}$ | $T_{OUT}$ | $T_{IN}$ | $T_{OUT}$ | $T_{IN}$ | $T_{OUT}$ |
| 255/340 | 437 | 425 | 412 | 392 | 370 | 350 | 340 | 270–285 |
| 255/300 | 437 | 430 | 416 | 395 | 380 | 340 | 297 | 256–285 |
| 255/220 | 450 | 430 | 416 | 398 | 385 | 359 | 220 | 240–255 |

Results

Grain Size

The annealed grain size of the three variants (specimens) is given in Table 3.

TABLE 3

Annealed Grain Size

| Sample | Annealed Grain Size (μm) | |
|---|---|---|
| | longitudinal | through thickness |
| 255/340 | 35.2 | 16.4 |
| 255/300 | 29.4 | 14.7 |
| 255/220 | 26.5 | 14.5 |

Tensile Properties and Formability

Figure 2:
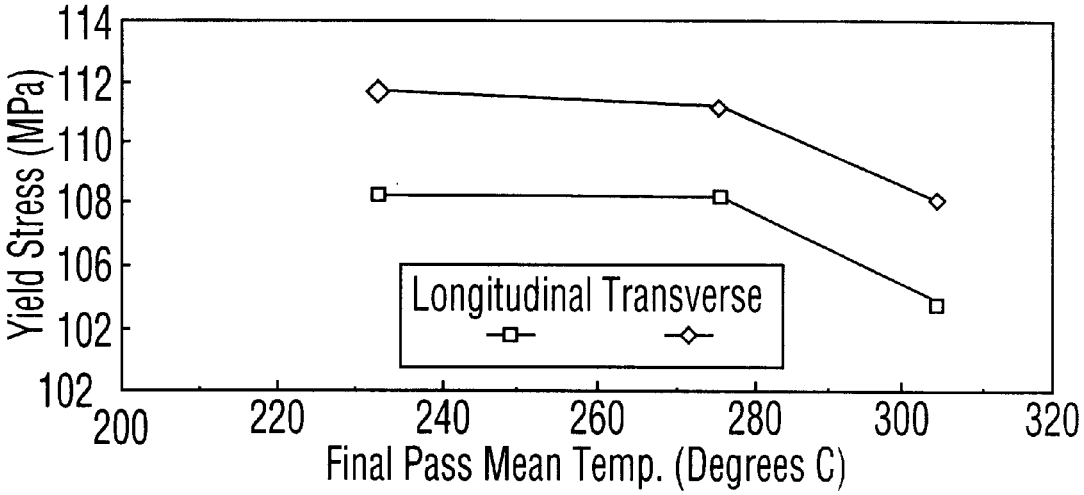
FIG. 2 is a graph showing the variation of yield strength with final pass mean temperature (i.e. average of highest and lowest temperature for the final rolling pass as shown in Table 2 provided later) for a process according to the present invention (based on data shown in Table 4 provided later)
Figure 3:
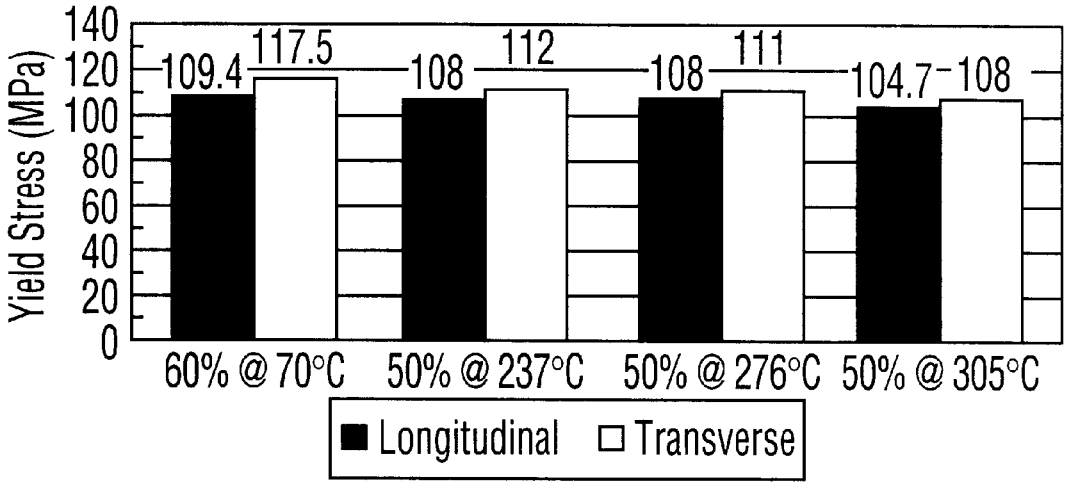
FIG. 3 is a graph of yield stress of products produced according to the present invention (the three pairs of yield stress bars plotted on the right of the chart based on information from Table 4 provided later) and according to a conventional process (the left most pair of bars) involving 60% cold reduction, i.e. cold rolling 60% at ambient temperature (typically the material will heat up to 70° C. in cold rolling on a laboratory cold mill).

Table 4 presents the longitudinal and transverse tensile properties (mechanical properties) as well as the formability for the three processing variants (specimens). The yield strength results are shown in FIGS. 2 and 3 (which plot the same data, but FIG. 2 has no data point for conventional processing—which is shown by the left-hand pair of bars in FIG. 3).

TABLE 4

Annealed Tensile Properties

| Sample | test gauge (mm) | test dir'n | UTS[1] (MPa) | 0.2% YS[2] (MPa) | Luder's Strain: YPE[3] | uniform elong'n (%) | total elong'n (%) | N value[4] | R value[5] @ 10% | Reduction of Area to Fracture[6] | $\epsilon_{3f}$[7] (true) |
|---|---|---|---|---|---|---|---|---|---|---|---|
| 255/340 | 2.16 | L | 224 | 104.7 | 1.01 | 22 | 25.7 | 0.327 | 0.68 | 0.94 | 0.73 |
| | 2.20 | T | 227.2 | 108 | — | — | 28 | 0.308 | 0.90 | 0.78 | 0.51 |
| 255/300 | 2.16 | L | 226 | 108 | 1.03 | 22 | 26 | 0.323 | 0.64 | 1.11 | 0.92 |
| | 2.17 | T | 227.8 | 111 | — | — | 28 | 0.30 | 0.86 | 0.78 | 0.52 |
| 255/220 | 2.12 | L | 226.8 | 108 | 1.12 | 19 | 21.8 | 0.328 | 0.60 | 1.10 | 0.93 |
| | 2.15 | T | 228 | 112 | — | — | 27 | 0.30 | 0.87 | 0.82 | 0.55 |

[1]Ultimate Tensile Strength.
[2]0.2% Yield Stress - 0.2% Proof Stress.
[3]Yield Point Elongation (ES-89).
[4]N value–is work hardening exponent (E646-93).
[5]R value–Plastic Strain Ratio (E517-81). Note that YPE, N value and R value are defined in The 1994 Annual Book of ASTM Standards, Volume 03.01.
[6]Reduction of area (R of A) to fracture might be better termed "true strain to fracture as determined by reduction in area": R of A = 1n ($A_o/A_f$) where: A is the cross-sectional area of the tensile specimen (length × width); Subscript o means original dimensions; and Subscript f means dimensions of fracture surface.
[7]$\epsilon_{3F}$ indicates true thickness strain to fracture.

EXAMPLE 2

Plane Strain Compression Tests

The laboratory scale rolling described in Table I was incapable of duplicating all the details of the hot reductions encountered in commercial scale processing, e.g limitations in mill power required that 4 passes be used to roll the material to the desired final gauge. Plane strain compression testing was performed in order to simulate hot rolling in line at the exit of a continuous caster using a pair of mills in tandem. Strains, strain rates and time between hits for the plane strain compression testing were typical of hot rolling under commercial processing conditions. (In this instance, "hit" means a single deformation in compression to simulate a single pass through a single mill stand). The deformation temperatures were selected to represent two types of cooling:

1. No forced cooling (tests A, B, C and D) with temperatures typical for warm rolling after continuous casting (the second deformation was 30° C. cooler than the first deformation). The different start temperatures for these 4 tests represent different caster exit temperatures (for the case of rolling mills situated near the caster exit).
2. Test E is a simulation of rolling according to the current invention. Forced cooling made the temperature of the second deformation much cooler than the first. Grain sizes are shown in Table 5 below.

TABLE 5

Effect of Hot Rolling Final Pass Temperature on Grain Size

| | Temperature (° C.) | | Grain Size After Anneal (microns) | |
|---|---|---|---|---|
| Test | Hit 1 | Hit 2 | Longitudinal | Through Thickness |
| A | 480 | 450 | 125 | 43 |
| B | 440 | 410 | 116 | 38 |
| C | 410 | 380 | 63 | 24 |
| D | 380 | 350 | 49 | 22 |
| E | 410 | 260 | 24 | 13 |

Tests A, B, C, D simulated roll temperatures typical of the prior art. Test E represented forced cooling for the final pass according to the invention; and yields a fine grain size which is associated with increased yield strength for AA5754 alloy.

Details of Plane Strain Compression Test

For all these industrial rolling simulation tests, the following applied:

1. Twin belt cast sample (of AA5754 alloy).
2. Samples start at a gauge of 17 mm. (machined from 19 mm as-cast slab).
3. Preheat to hit 1 temperature.
4. Hit 1 to 6.45 mm at a strain rate of 4/s.
5. Wait 16 seconds, cool to Hit 2 temperature.
6. Hit 2 to 2.15 mm at a strain rate of 25/s.
7. Water quench.
8. Anneal 1 hour @ 450° C.

What we claim is:

1. A process of producing an aluminum alloy sheet article, which comprises:

casting a non heat-treatable aluminum alloy to form a cast slab; and subjecting said cast slab to a series of rolling steps to produce a sheet article of final gauge;

the rolling step comprising:

hot an warm rolling the cast slab to form an intermediate sheet article of intermediate gauge;

cooling the intermediate sheet article by forced cooling;

warm and cold rolling the cooled intermediate sheet article to final gauge at a temperature in the range of ambient temperature to 340° C. to form said sheet article of final gauge; and then annealing the sheet article of final gauge to cause recrystallization;

said series of rolling steps being carried out continuously without intermediate coiling or full annealing of the intermediate sheet article.

2. A process according to claim 1, wherein said warm and cold rolling is carried out a temperature in the range of ambient to 280° C.

3. A process according to claim 1, wherein said annealing of the sheet article of final gauge is carried out by batch annealing.

4. A process according to claim 1, wherein said annealing of the sheet article of final gauge is carried out by continuous annealing.

5. A process according to claim 1, wherein said intermediate sheet article is reduced in thickness by at least 20% during said warm and cold rolling to final gauge.

6. A process according to claim 1, wherein said intermediate sheet article is reduced in thickness by at least 60% during said warm and cold rolling to final gauge.

7. A process according to claim 1, wherein said rolling steps are carried out in a tandem mill.

8. A process according to claim 1, wherein said forced cooling is brought about by a method selected from the group consisting of spraying water onto said sheet article of intermediate gauge and force air cooling.

9. A process according to claim 8, wherein said sheet article of intermediate gauge has opposite sides, and said water is sprayed onto both of said opposite sides of said sheet article of intermediate gauge.

10. A process according to claim 1, wherein said cast slab is east in a twin belt caster.

11. A process according to claim 1, wherein said aluminum alloy is AA5182.

12. A process according to claim 1, wherein said aluminum alloy is AA5754.

13. A process of producing an aluminum alloy sheet article of final gauge from a cast slab of non heat-treatable aluminum alloy, which comprises subjecting said cast slab to a series of rolling steps, said rolling steps including a final warm and cold rolling step in which an intermediate sheet article, following forced cooling, is rolled to final gauge at a temperature in the range of ambient temperature to 340° C. to form said sheet article of final gauge, said sheet article of final gauge then being subjected to annealing to cause recrystallization; said rolling steps being carried out continuously without intermediate coiling or full annealing of the intermediate sheet article.

* * * * *